US012090359B1

(12) United States Patent
Gonzalez

(10) Patent No.: US 12,090,359 B1
(45) Date of Patent: Sep. 17, 2024

(54) ELECTROMAGNETIC RESISTANCE SMART GYM HAVING QUICK ATTACH PULLEYS AND INTERCHANGEABLE ATTACHMENTS

(71) Applicant: Terrence Gonzalez, Irvine, CA (US)

(72) Inventor: Terrence Gonzalez, Irvine, CA (US)

( * ) Notice: Subject to any disclaimer, the term of this patent is extended or adjusted under 35 U.S.C. 154(b) by 0 days.

(21) Appl. No.: 18/411,006

(22) Filed: Jan. 11, 2024

(51) Int. Cl.
*A63B 21/00* (2006.01)
*A63B 21/005* (2006.01)
*A63B 22/00* (2006.01)
*A63B 22/06* (2006.01)

(52) U.S. Cl.
CPC ..... *A63B 21/156* (2013.01); *A63B 21/0058* (2013.01); *A63B 21/4029* (2015.10); *A63B 22/0076* (2013.01); *A63B 22/0605* (2013.01); *A63B 2022/0079* (2013.01)

(58) Field of Classification Search
CPC ..... A63B 21/156; A63B 21/0058; A63B 21/4029; A63B 22/0076; A63B 22/0605; A63B 2022/0079; A63B 21/154; A63B 21/151; A63B 21/15; A63B 21/16
See application file for complete search history.

(56) References Cited

U.S. PATENT DOCUMENTS 5,823,921 A * 10/1998 Dawson ..... A63B 21/00181 482/93
10,220,235 B2 * 3/2019 Norris ..... A63B 21/153
11,007,398 B2 * 5/2021 Neuhaus ..... A63B 23/03525
11,298,577 B2 * 4/2022 Watterson ..... A63B 21/4035
2005/0233874 A1 * 10/2005 Bucay-Bissu ..... A63B 24/00 482/142
2016/0346601 A1 * 12/2016 Marcandelli ..... A63B 23/0244
2019/0344123 A1 * 11/2019 Rubin ..... A63B 69/0057
2021/0236876 A1 * 8/2021 Gregory ..... A63B 21/4033
2022/0184452 A1 * 6/2022 Valente ..... A63B 21/4033
(Continued)

OTHER PUBLICATIONS

Google Search (Flip Flop Pulley) (Year: 2024).*

*Primary Examiner* — Loan B Jimenez
*Assistant Examiner* — Andrew M Kobylarz
(74) *Attorney, Agent, or Firm* — Pharar Patents & Intellectual Property; Andrew A. Pharar

(57) ABSTRACT

The electromagnetic resistance smart gym having quick attach pulleys and interchangeable attachments may allow a user to adjust any of a number of quick-attach pulleys to provide the angle and resistance requirement for a wider variety of exercises without the limitations or complexities mentioned above. The electromagnetic resistance smart gym having quick attach pulleys and interchangeable attachments may comprise a universal base to which a plurality of interchangeable attachments may be affixed so that the user may perform various exercises. The device may further comprise a plurality of motors and spools that allow for fine control over the exercise cables of the device. A pair of articulating and extending arms may be affixed to the base for further adjustability, and the various attachments may comprise a locking mechanism. Some of the various attachments may further comprise a scotch yolk mechanism or internal pulleys and cables to provide continuous resistance to the exercise being performed. The continuous resistance is provided by the linking of the two motors causing them to be pulled in opposing directions during exercise.

6 Claims, 13 Drawing Sheets

(56) References Cited

U.S. PATENT DOCUMENTS

| | | | | |
|---|---|---|---|---|
| 2023/0009699 | A1* | 1/2023 | Ferlito | A63B 21/0552 |
| 2023/0028361 | A1* | 1/2023 | Neuhaus | A63B 24/0087 |
| 2023/0103725 | A1* | 4/2023 | Neuhaus | A63B 21/156 482/5 |
| 2024/0009522 | A1* | 1/2024 | Huber | A63B 23/12 |

* cited by examiner

ELECTROMAGNETIC RESISTANCE SMART GYM HAVING QUICK ATTACH PULLEYS AND INTERCHANGEABLE ATTACHMENTS

TECHNICAL FIELD OF THE INVENTION

The present invention relates in general to gym equipment, and, more specifically, to an electromagnetic resistance smart gym having quick attach pulleys and interchangeable attachments.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Exercise equipment is a well-known art and, while exercise has been known since the time of the ancient Greeks, such equipment has become popularized in the last sixty or so years. A vast number of public and private gyms exist, all tending to possess similar types of equipment. Treadmills, for example, are a popular class of device used to replicate walking or running. Free weights and weight machines of varying designs are also popularly used for developing muscle mass and strength. Rowing machines and stationary bicycles, and similar devices, are used to replicate the movement of a sport or activity without requiring the user to be travelling a remote river or bike path.

With the advent of mobile technology and increasing demand for remote accessibility, a number of home gym solutions have become available. The most comprehensive and original type of home gym may be the "all-in-one gym", which comprises a combination of frames, pulleys, cables, weights, and various attachments that allow a user to perform a multitude of exercise. The user is able to connect, disconnect, or move components from one orientation to another to prepare the machine to perform a specific exercise movement. The generally smaller form-factor of the combination frame allows such a device to be contained within a room in a home, for example, as opposed to requiring multiple different machines or devices spread out across the hall of a public gym.

Most recently the "smart home gym" has become a popular technology that allows a user to perform a number of exercises in their home while connected to a computer, tablet, television, or other smart device. The smart technology of the device allows the user to watch or stream lessons, environments, shows and movies, interact remotely with an instructor while performing their exercises, and keep track of user data through data analytics. Some smart home gyms only comprise a single exercise device, such as a stationary bicycle, but others have been developed to include adjustable arms and pulleys that allow the user to perform variations on one or more exercises. Variations of smart home gyms may also comprise a plurality of attachments that may be installed or removed to perform additional exercises. Still other such devices comprise a form factor that is able to be folded down or collapsed sufficiently to be stored under a bed or in a closet so that they can be put away when not in use.

One problem inherent in such devices is that they require weights or resistance to increase exercise effort and difficulty. Often the user is pushing or pulling against a stack of weights or a rotary mechanism with adjustable drag or a brake. Such a design, though, necessarily applies resistance to the user's movements in only a single direction, or during the exertion phase of an exercise movement, but does not apply resistance to movement in the return motion.

A second problem inherent in such devices is their use of fixed pulley systems for adjusting exercise effort and direction. A device having stationary fixed pulleys is limited in the angle or direction in which exercise can be performed and, thus, is limited in the attachments for exercises that may be implemented. Some devices known in the art may have a pulley rail system, which may allow pulleys to be positioned anywhere along the length of a rail system, but such systems are also necessarily limited in the height and angle through which exercises may be performed. Other devices may comprise an articulating arm system along which the pulley may be positioned, though such devices are the least limited in certain exercise angles however the design of the system is made more complicated by the actions of the arms and the routing of the pulleys.

Thus, there is a need in the art for an electromagnetic resistance smart gym having quick attach pulleys and interchangeable attachments that may allow a user to adjust any of a number of quick-attach pulleys to provide the angle and resistance requirement for a wider variety of exercises without the limitations or complexities mentioned above. The electromagnetic resistance smart gym having quick attach pulleys and interchangeable attachments may comprise a universal base to which a plurality of interchangeable attachments may be affixed so that the user may perform various exercises. The device may further comprise a plurality of motors and spools that allow for fine control over the exercise cables of the device. A pair of articulating and extending arms may be affixed to the base for further adjustability, and the various attachments may comprise a locking mechanism. Some of the various attachments may further comprise a scotch yolk mechanism or internal pulleys and cables to provide continuous resistance to the exercise being performed. The continuous resistance is provided by the linking of the two motors causing them to be pulled in opposing directions during exercise. It is to these ends that the present invention has been developed.

BRIEF SUMMARY OF THE INVENTION

To minimize the limitations in the prior art, and to minimize other limitations that will be apparent upon reading and understanding the present specification, the present invention describes an electromagnetic resistance smart gym having quick attach pulleys and interchangeable attachments.

It is an objective of the present invention to provide an electromagnetic resistance smart gym having quick attach pulleys and interchangeable attachments that may comprise a universal base.

It is another objective of the present invention to provide an electromagnetic resistance smart gym having quick attach pulleys and interchangeable attachments that may comprise a main body.

It is another objective of the present invention to provide an electromagnetic resistance smart gym having quick attach pulleys and interchangeable attachments that may comprise an upper housing.

It is another objective of the present invention to provide an electromagnetic resistance smart gym having quick attach pulleys and interchangeable attachments that may comprise a lower housing.

It is another objective of the present invention to provide an electromagnetic resistance smart gym having quick attach pulleys and interchangeable attachments that may comprise a plurality of motors.

It is another objective of the present invention to provide an electromagnetic resistance smart gym having quick attach pulleys and interchangeable attachments that may comprise a plurality of spools.

It is another objective of the present invention to provide an electromagnetic resistance smart gym having quick attach pulleys and interchangeable attachments that may comprise a plurality of cables.

It is another objective of the present invention to provide an electromagnetic resistance smart gym having quick attach pulleys and interchangeable attachments that may comprise a plurality of fixed flip-flop pulleys.

It is another objective of the present invention to provide an electromagnetic resistance smart gym having quick attach pulleys and interchangeable attachments that may comprise a plurality of ball stoppers.

It is another objective of the present invention to provide an electromagnetic resistance smart gym having quick attach pulleys and interchangeable attachments that may comprise a plurality of pulley receivers.

It is another objective of the present invention to provide an electromagnetic resistance smart gym having quick attach pulleys and interchangeable attachments that may comprise a plurality of arms.

It is another objective of the present invention to provide an electromagnetic resistance smart gym having quick attach pulleys and interchangeable attachments that may comprise a plurality of arm pivot locks.

It is another objective of the present invention to provide an electromagnetic resistance smart gym having quick attach pulleys and interchangeable attachments that may comprise a plurality of arm extension locks.

It is another objective of the present invention to provide an electromagnetic resistance smart gym having quick attach pulleys and interchangeable attachments that may comprise a plurality of post receivers.

It is another objective of the present invention to provide an electromagnetic resistance smart gym having quick attach pulleys and interchangeable attachments that may comprise a locking post.

It is another objective of the present invention to provide an electromagnetic resistance smart gym having quick attach pulleys and interchangeable attachments that may comprise a plurality of air intakes.

It is another objective of the present invention to provide an electromagnetic resistance smart gym having quick attach pulleys and interchangeable attachments that may comprise a plurality of air exhausts.

It is another objective of the present invention to provide an electromagnetic resistance smart gym having quick attach pulleys and interchangeable attachments that may comprise a plurality of wheels.

It is another objective of the present invention to provide an electromagnetic resistance smart gym having quick attach pulleys and interchangeable attachments that may comprise a plurality of pulleys.

It is another objective of the present invention to provide an electromagnetic resistance smart gym having quick attach pulleys and interchangeable attachments that may comprise a plurality of posts.

It is another objective of the present invention to provide an electromagnetic resistance smart gym having quick attach pulleys and interchangeable attachments that may comprise a plurality of locking brackets.

It is another objective of the present invention to provide an electromagnetic resistance smart gym having quick attach pulleys and interchangeable attachments that may comprise a plurality of locking pins.

It is another objective of the present invention to provide an electromagnetic resistance smart gym having quick attach pulleys and interchangeable attachments that may comprise a plurality of barbells.

It is another objective of the present invention to provide an electromagnetic resistance smart gym having quick attach pulleys and interchangeable attachments that may comprise a workout bench.

It is another objective of the present invention to provide an electromagnetic resistance smart gym having quick attach pulleys and interchangeable attachments that may comprise a vertical climber.

It is another objective of the present invention to provide an electromagnetic resistance smart gym having quick attach pulleys and interchangeable attachments that may comprise a rowing machine.

It is another objective of the present invention to provide an electromagnetic resistance smart gym having quick attach pulleys and interchangeable attachments that may comprise a stationary bicycle.

It is another objective of the present invention to provide an electromagnetic resistance smart gym having quick attach pulleys and interchangeable attachments that may comprise a scotch yolk mechanism.

It is another objective of the present invention to provide an electromagnetic resistance smart gym having quick attach pulleys and interchangeable attachments that may comprise a resilient material of construction.

It is another objective of the present invention to provide an electromagnetic resistance smart gym having quick attach pulleys and interchangeable attachments that may comprise a water-proof material of construction.

It is another objective of the present invention to provide an electromagnetic resistance smart gym having quick attach pulleys and interchangeable attachments that may comprise a reusable material of construction.

It is another objective of the present invention to provide an electromagnetic resistance smart gym having quick attach pulleys and interchangeable attachments that may comprise a washable material of construction.

It is another objective of the present invention to provide an electromagnetic resistance smart gym having quick attach pulleys and interchangeable attachments that may comprise a multi-component construction.

It is another objective of the present invention to provide an electromagnetic resistance smart gym having quick attach pulleys and interchangeable attachments that may comprise an antimicrobial layer.

It is another objective of the present invention to provide an electromagnetic resistance smart gym having quick attach pulleys and interchangeable attachments that may comprise an antimicrobial material of construction.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE INVENTION

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

The electromagnetic resistance smart gym having quick attach pulleys and interchangeable attachments may allow a user to adjust any of a number of quick-attach pulleys to provide the angle and resistance requirement for a wider variety of exercises without the limitations or complexities mentioned above. The electromagnetic resistance smart gym having quick attach pulleys and interchangeable attachments may comprise a universal base to which a plurality of interchangeable attachments may be affixed so that the user may perform various exercises. The device may further comprise a plurality of motors and spools that allow for fine control over the exercise cables of the device. A pair of articulating and extending arms may be affixed to the base for further adjustability, and the various attachments may comprise a locking mechanism. Some of the various attachments may further comprise a scotch yolk mechanism or internal pulleys and cables to provide continuous resistance to the exercise being performed. The continuous resistance is provided by the linking of the two motors causing them to be pulled in opposing directions during exercise.

Figure 1:
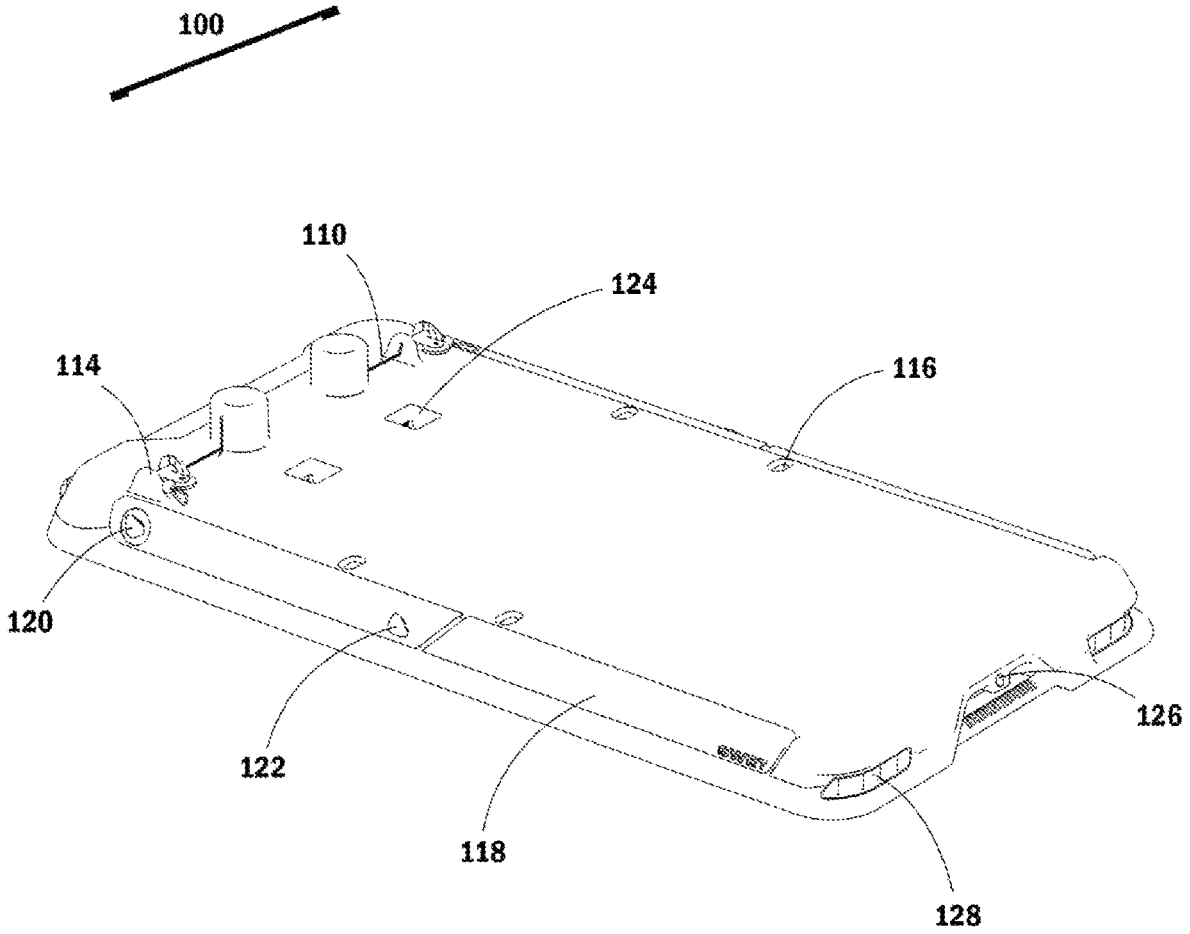
FIG. 1 is an isometric perspective view of a main body of an electromagnetic resistance smart gym having quick attach pulleys and interchangeable attachments, as contemplated by the present disclosure.
Figure 2:
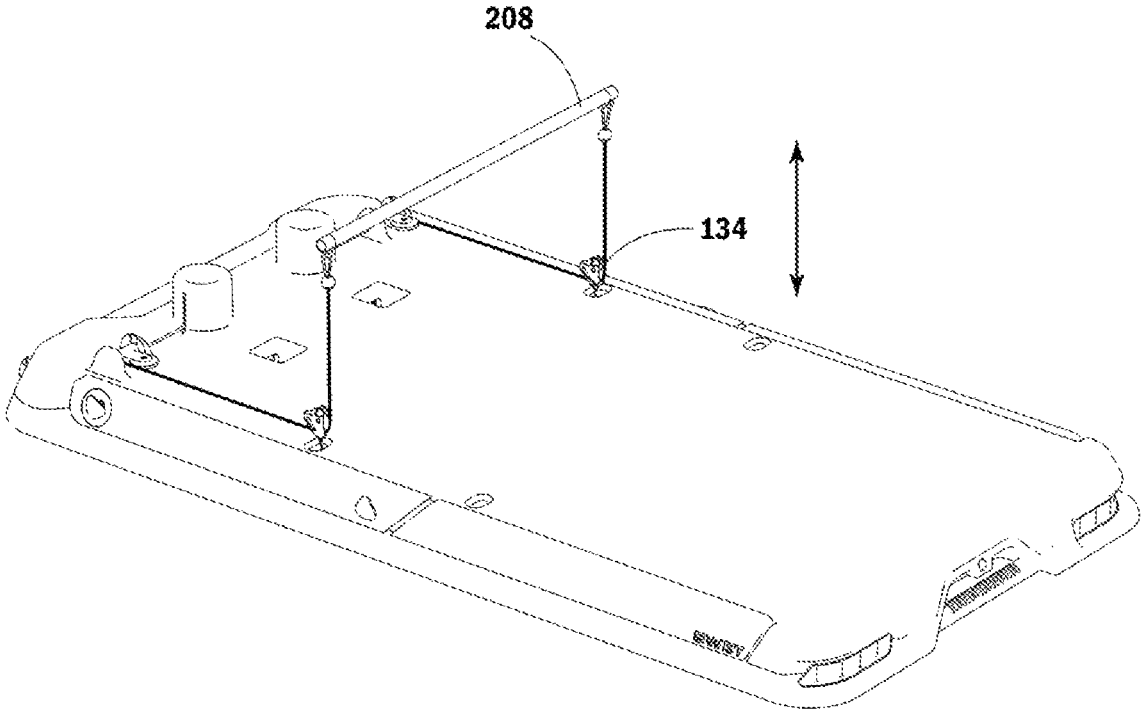
FIG. 2 is an isometric perspective view of a main body of an electromagnetic resistance smart gym having quick attach pulleys and interchangeable attachments with a barbell attached, as contemplated by the present disclosure.
Figure 3:
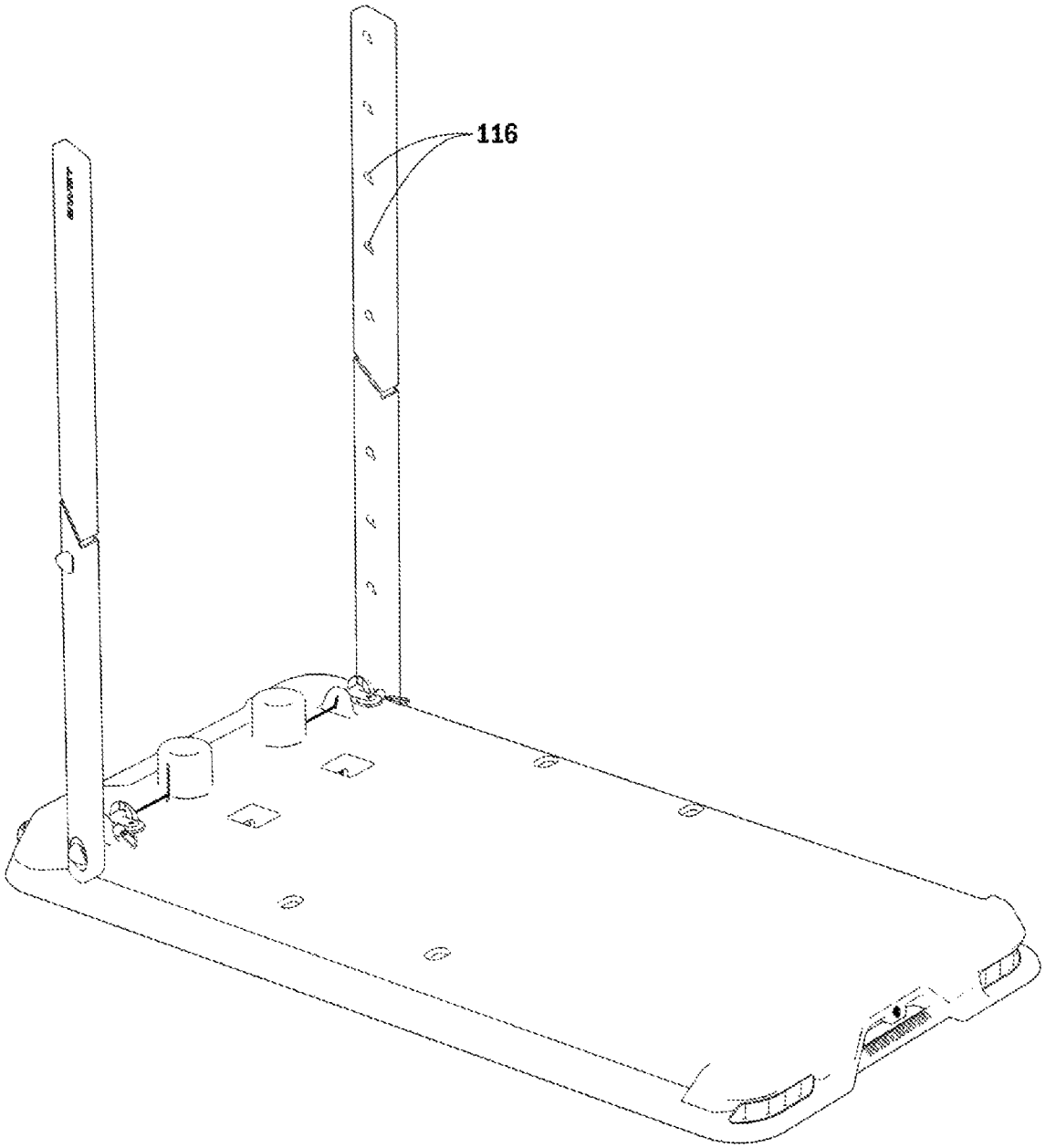
FIG. 3 is an isometric perspective view of a main body of an electromagnetic resistance smart gym having quick attach pulleys and interchangeable attachments with arms raised, as contemplated by the present disclosure.
Figure 4:
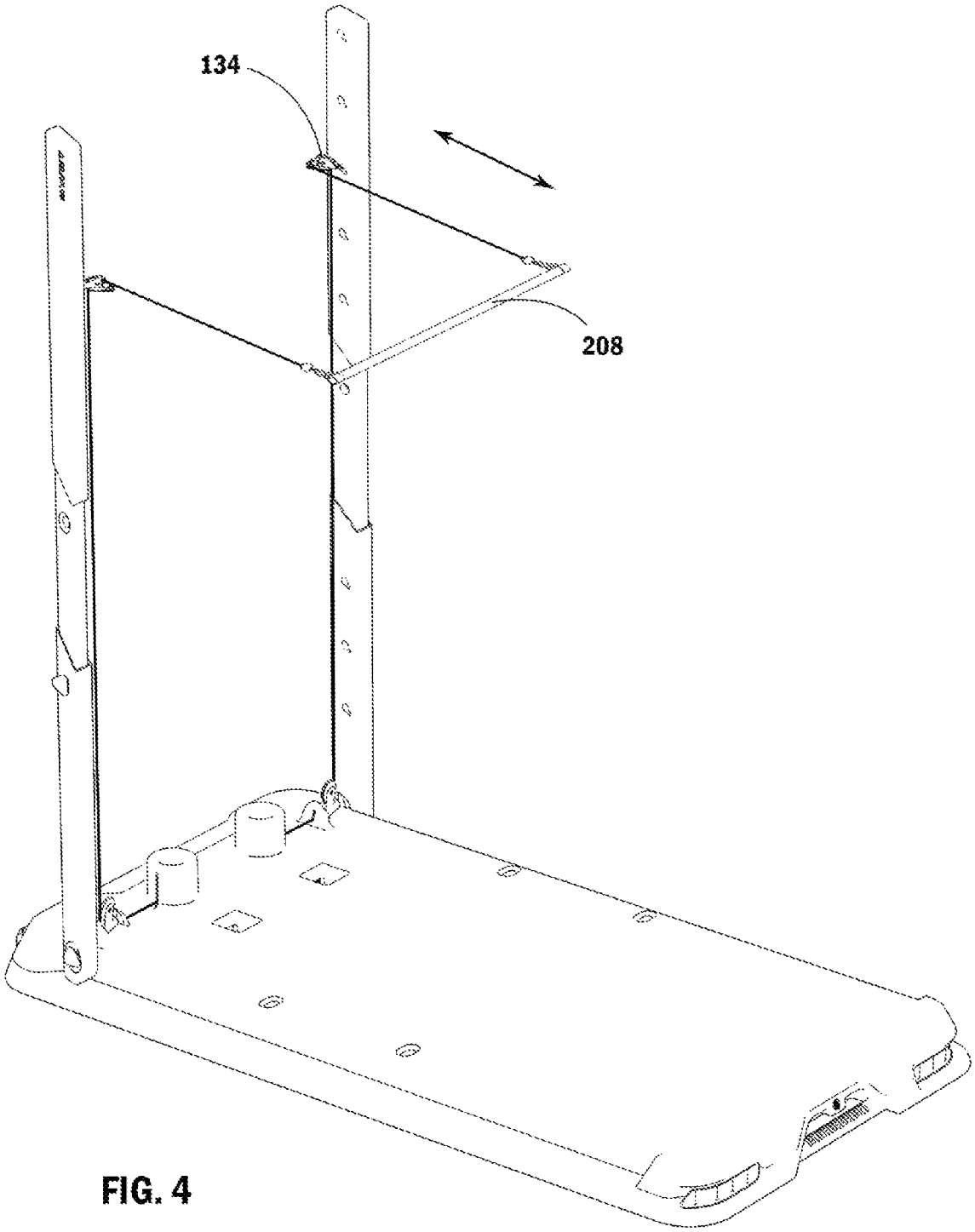
FIG. 4 is an isometric perspective view of a main body of an electromagnetic resistance smart gym having quick attach pulleys and interchangeable attachments with arms raised and extended and a barbell attached, as contemplated by the present disclosure.
Figure 5:
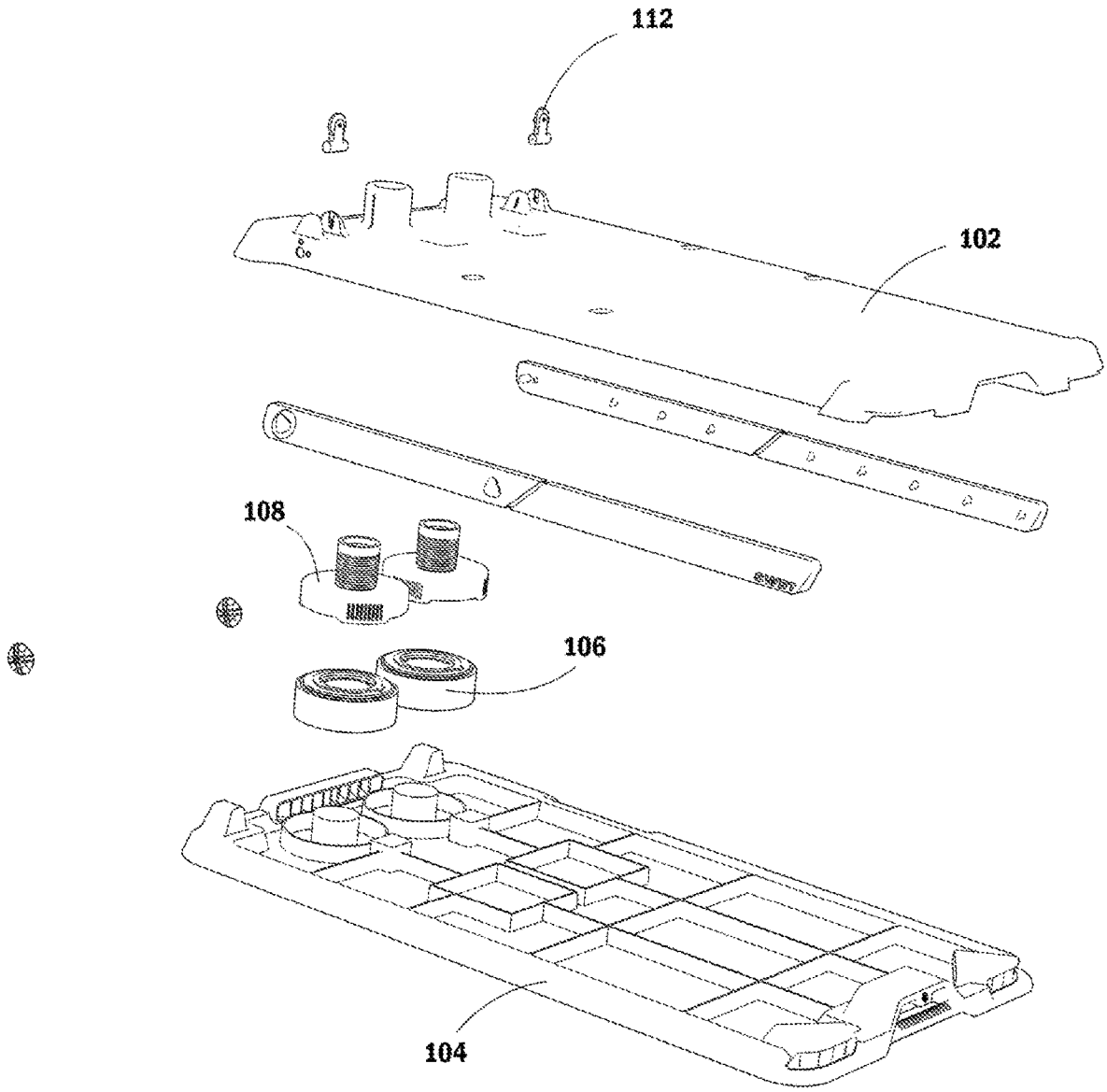
FIG. 5 is an exploded view of a main body of an electromagnetic resistance smart gym having quick attach pulleys and interchangeable attachments, as contemplated by the present disclosure.
Figure 6:
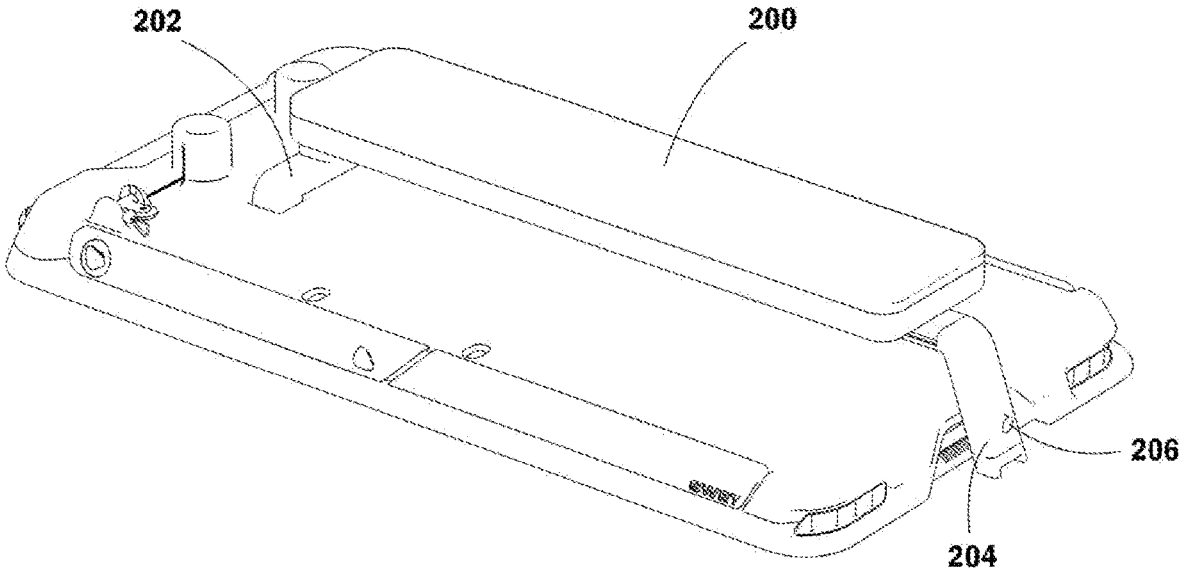
FIG. 6 is an isometric perspective view of a main body of an electromagnetic resistance smart gym having quick attach pulleys and interchangeable attachments with an attached workout bench, as contemplated by the present disclosure.
Figure 7:
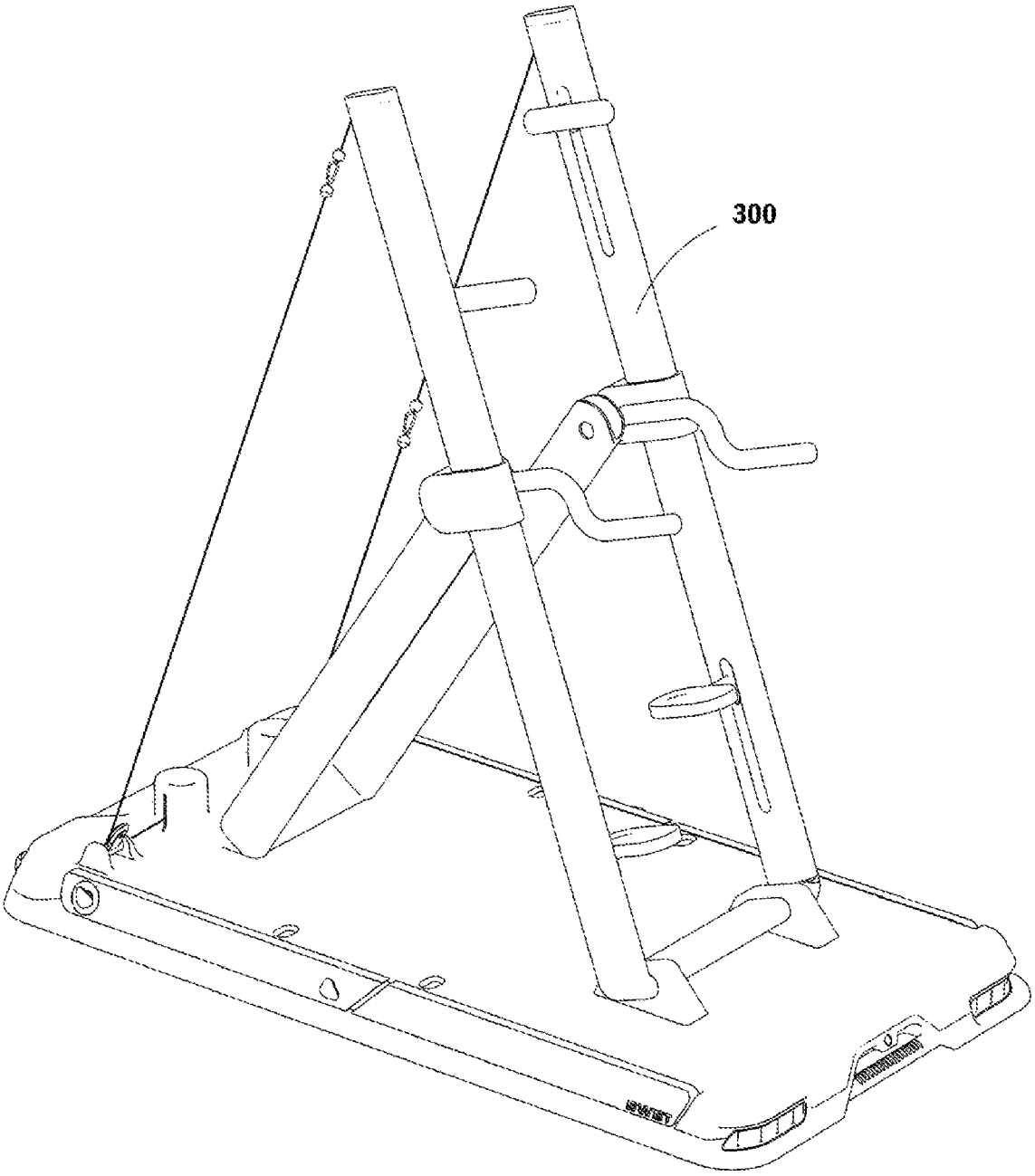
FIG. 7 is an isometric perspective view of a main body of an electromagnetic resistance smart gym having quick attach pulleys and interchangeable attachments with an attached vertical climber showing an internal cable, as contemplated by the present disclosure.
Figure 8:
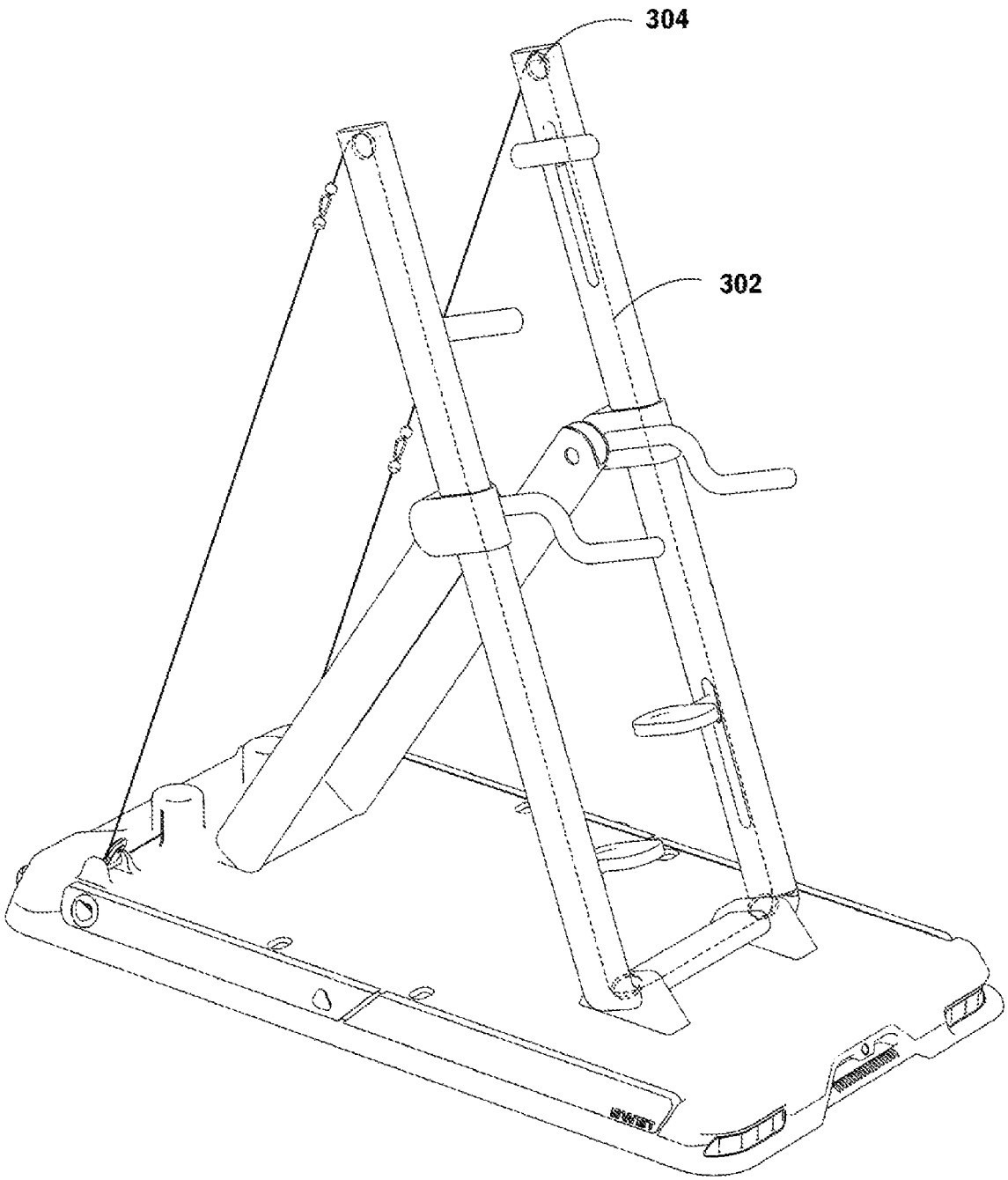
FIG. 8 is an isometric perspective view of a main body of an electromagnetic resistance smart gym having quick attach pulleys and interchangeable attachments with an attached vertical climber, as contemplated by the present disclosure.
Figure 9:
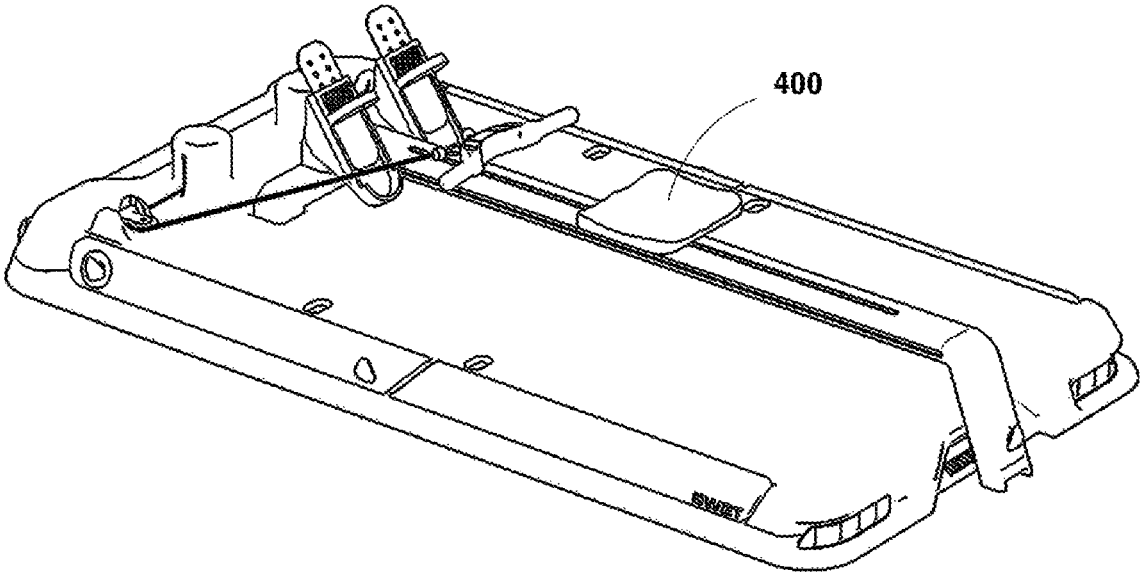
FIG. 9 is an isometric perspective view of a main body of an electromagnetic resistance smart gym having quick attach pulleys and interchangeable attachments with an attached rowing machine, as contemplated by the present disclosure.
Figure 10:
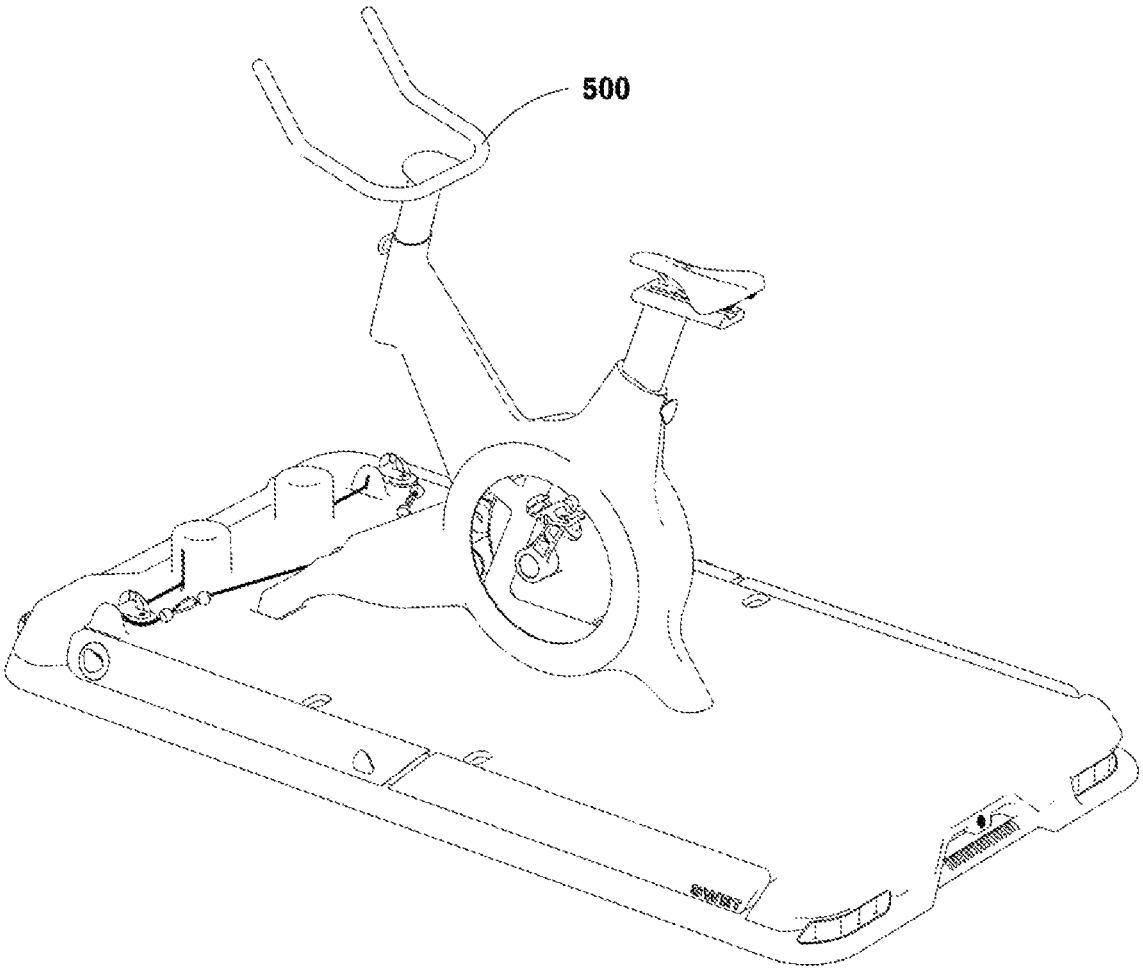
FIG. 10 is an isometric perspective view of a main body of an electromagnetic resistance smart gym having quick attach pulleys and interchangeable attachments with an attached stationary bicycle, as contemplated by the present disclosure.
Figure 11:
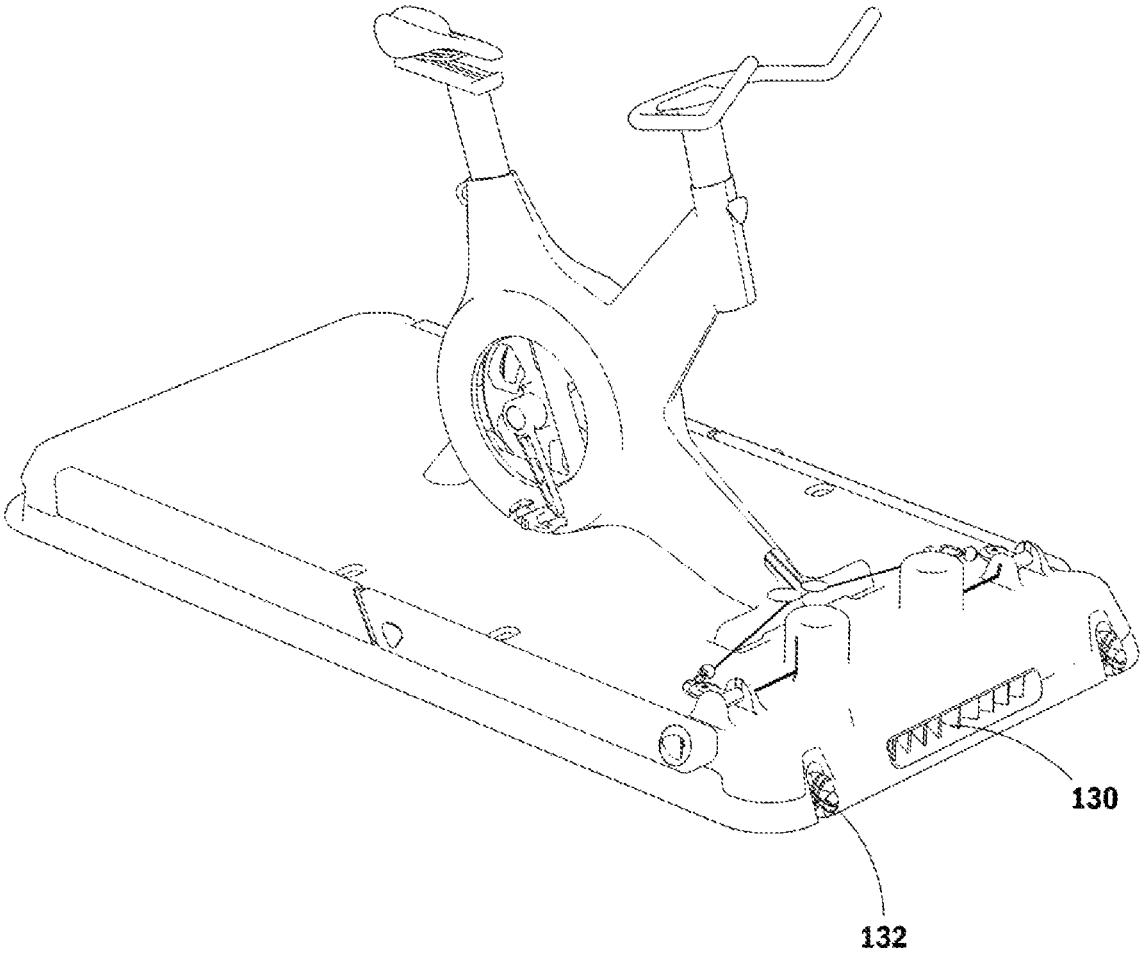
FIG. 11 is an isometric perspective view of a main body of an electromagnetic resistance smart gym having quick attach pulleys and interchangeable attachments with an attached stationary bicycle, as contemplated by the present disclosure.
Figure 12:
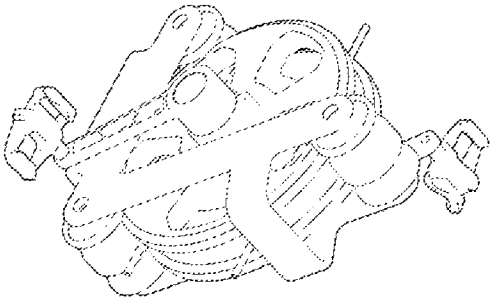
FIG. 12 is an exploded view of a scotch yolk mechanism of an electromagnetic resistance smart gym having quick attach pulleys and interchangeable attachments, as contemplated by the present disclosure.
Figure 12:
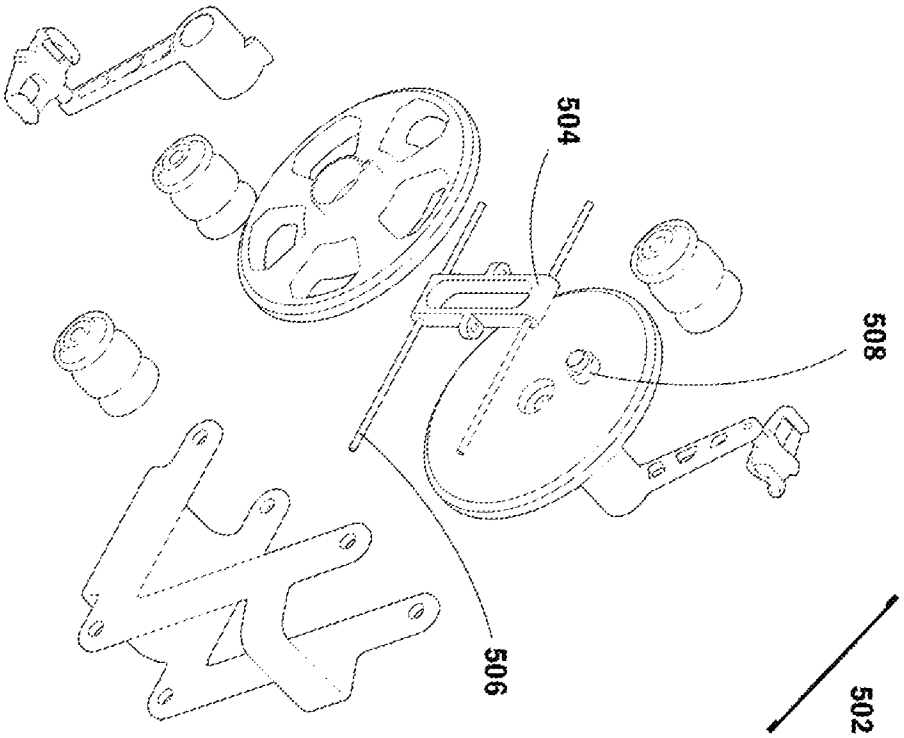
Figure 13:
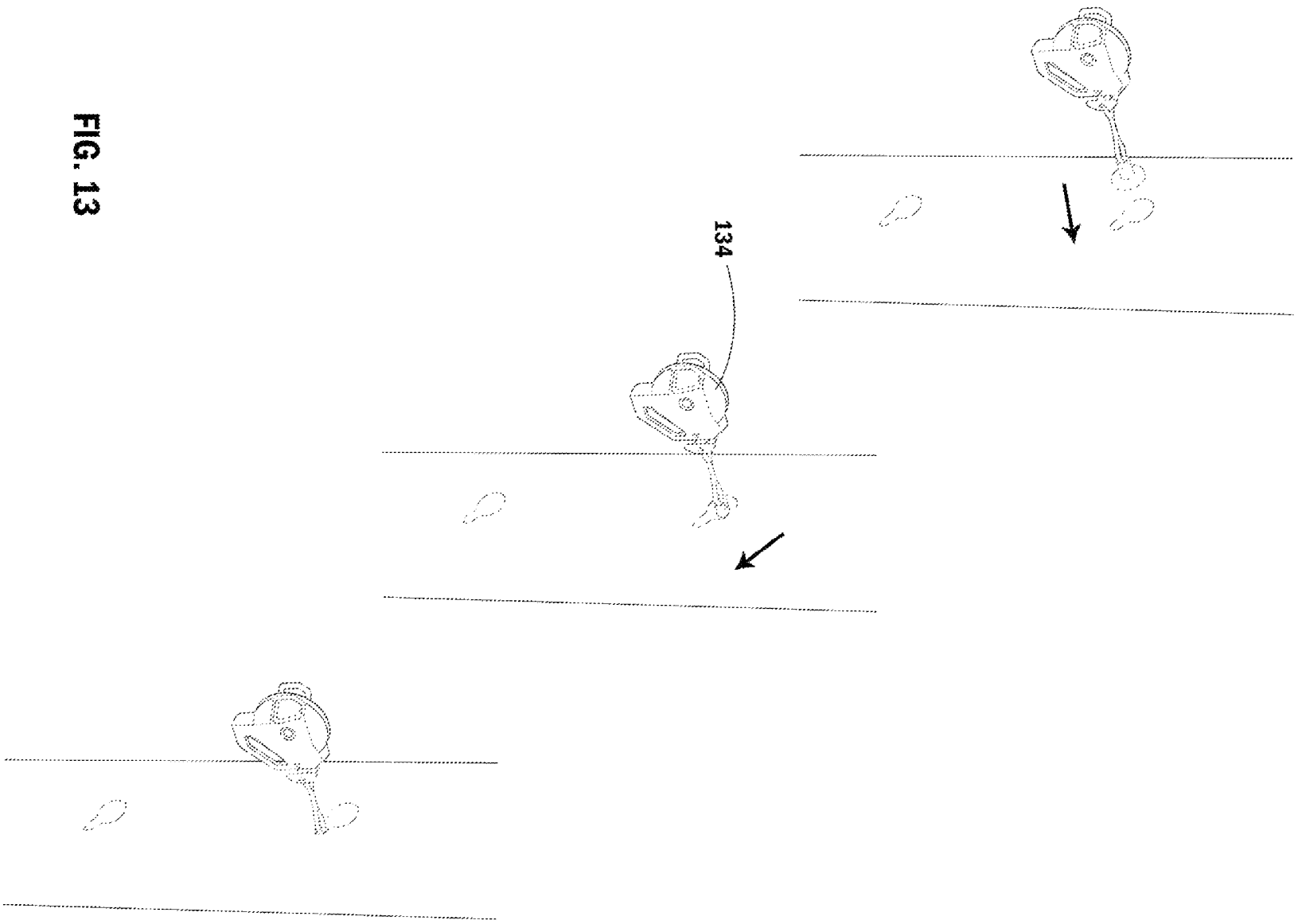
FIG. 13 is an overall view of an adjustable pulley of an electromagnetic resistance smart gym having quick attach pulleys and interchangeable attachments, as contemplated by the present disclosure.

The illustrations of FIGS. 1-13 illustrate an electromagnetic resistance smart gym having quick attach pulleys and interchangeable attachments, as contemplated by the present disclosure. The device may comprise, generally, a main body 100 and an interchangeable attachment.

The main body 100 may comprise a base for the system such as, for example, a horizontal plate or housing containing the common components thereof. The main body 100 may comprise an upper housing 102 and a lower housing 104, into which are placed the components necessary for creating resistance within the system such as, for example, the plurality of motors 106 and the plurality of spools 108.

The plurality of motors 106 may comprise any appropriate electric or electromagnetic motors that are capable of creating a rotational force such as, for example, brushless motors, stepper motors, induction motors, or synchronous motors. In one embodiment an appropriate motor may comprise a high torque direct drive motor having speed controllability.

The plurality of spools 108 may comprise any appropriate spools that may attach, one each, to the plurality of motors 106 and around which one each of a plurality of cables 110 may be wound. The plurality of spools 108 may be attached to the plurality of motors 106 by any appropriate mechanism that allows the motor to spin the spool and either wind or unwind each of the plurality of cables 110. By this mechanism the rotation of one of the motors 106 may wind a cable 110 around a spool 108 to create tension or a resistance to pulling on the cable 110.

The speed and action of the plurality of motors 106 may be controlled electronically, and a proprietary software may be implemented to program or command when the plurality of motors 106 are activated. By this programming the plurality of motors 106 can be instructed when to start and stop, how much force to output, and when to fail safe in the event of an emergency or in response to specific parameters.

When assembled, the upper housing 102 and lower housing 104 may enclose the plurality of motors 106 and plurality of spools 108, and the plurality of spools 108 may have one each of the plurality of cables 110 wound around them. The cables 110 may exit from the internal cavity of the main body 100 and may first run through a plurality of fixed flip-flop pulleys 112, which may be mounted, one each, within a plurality of ball stoppers 114. The distal ends of each of the cables 110 may run through a ball, such as a rubber ball, and be tied to a mechanism of attachment such as, for example, a hook or a carabineer. By this mechanism the ball may be held against the mechanism of attachment at each end of the cables 110, and the plurality of ball stoppers 114 may catch or block the ball and prevent each of the cables 110 from retracting into the internal cavity of the main body 100.

The enclosure of the upper housing 102 around the plurality of spools 108 may comprise a housing that only provides sufficient space to accommodate the diameter of the cables 110, and the plurality of spools 108 may comprise a threaded body with threads wide enough to accommodate the diameter of the cables 110. The opening of the upper housing 102 from which the cables 100 exit may comprise a slit only wide enough to accommodate the diameter of the cables 110. By this design, as the cables 110 are retracted into the internal cavity of the main body 100 they are automatically threaded onto their respective spools 108 and not allowed to overlap and bind within the internal cavity of the main body 100.

The main body 100 may further comprise a plurality of pulley receivers 116 into which one each of a plurality of adjustable pulleys 134 may be attached. Each of the plurality of adjustable pulleys 134 may be attached to one each of the plurality of pulley receivers 116 by any appropriate mechanism such as, for example, a hook, a carabineer, or a T-fitting inserted into a locking slot. The plurality of adjustable pulleys 134 may further comprise a slot into which an end of the cable 110 may be inserted so that it may be wound around the additional pulley. By this mechanism the cable 110 may be routed to additional locations around the main body 100, as desired, to allow the user to perform various exercises.

By way of example, in one embodiment wherein said plurality of cables 110 exit said main housing 100 from a first end, a user may be standing on said main body 100 at approximately a middle section some two to three feet away from said first end. A barbell 208 attached to said plurality of cables 110 immediately after said plurality of ball stoppers 114 may allow the user to pull the plurality of cables towards themselves along the horizontal or at an acute upward angle. In the alternative, a barbell 208 attached to a pair of adjustable pulleys 134 installed into a pair of pulley receivers 116 in the upper housing 102 may allow the user to, instead, push the barbell 208 away from themselves along the vertical or at an acute upward angle.

The main body 100 may further comprise a plurality of arms 118, which may be attached to either side of the main body 100. Each of the plurality of arms 118 may comprise a pivoting end and an extending end. The pivoting end of each of the plurality of arms 118 may be attached to the main body 100 and may further comprise an arm pivot lock 120. The arm pivot lock 120 may be any appropriate lock such as, for example, a spring-loaded pin or a detent, which may engage to lock each of the plurality of arms 118 relative to the main body 100 and which may be unlocked to articulate each of the plurality of arms 118 relative to the main body 100.

The extending end of each of the plurality of arms 118 may be attached to the pivoting end and may further comprise an arm extension lock 122. The arm extension lock 122 may be any appropriate lock such as, for example, a spring loaded pin or a detent, which may engage to lock each of the plurality of extending ends relative to the pivoting ends and which may be unlocked to extend each of the plurality of arms 118 relative to the main body 100.

Each of the plurality of arms 118 may further comprise a plurality of pulley receivers 116 into which one each of a plurality of adjustable pulleys 134 may be attached. By this mechanism the cable 110 may be routed to additional locations around the main body 100, as desired, to allow the user to perform various exercises.

By way of example, in an embodiment wherein said plurality of cables 110 exit said main housing 100 from a first end and said plurality of arms 118 are pivoted and extended, a user may be standing on said main body 100 at approximately a middle section some two to three feet away from said first end. A barbell 208 attached to a pair of adjustable pulleys 134 installed into said plurality of arms 118 may allow the user to pull the barbell 208 towards themselves along the horizontal or at an acute downward angle.

The main body 100 may further comprise a plurality of air intakes 128 and a plurality of air exhausts 130, which may each comprise openings in the main body 100 leading to the internal cavity of the device. These air intakes 128 and air exhausts 130 may allow for airflow through the internal cavity of the main body 100 for the purpose of cooling the plurality of motors 106. The main body 100 may further comprise a plurality of fans to aid in creating such airflow through the internal cavity.

The main body 100 may further comprise a plurality of wheels 132, which may be any wheels appropriate for allowing the main body 100 to be rolled across a surface. The plurality of wheels 132 may be attached to the main body 100 such that the plurality of wheels 132 do not touch a surface when the main body 100 is laid flat, but that the plurality of wheels 132 do touch a surface when the main body 100 is tilted up from one side.

To allow for the interchangeability of attachments the main body 100 may further comprise a plurality of post receivers 124, which may comprise any appropriate post receivers known in the art. The plurality of post receivers may comprise standardized openings in the upper housing 102 that lead to standardized bases in the lower housing 104. By this mechanism any attachment having an appropriately shaped plurality of posts 202 may be attached to the main body 100 by inserting the plurality of posts 202 into the plurality of post receivers 124.

The main body 100 may further comprise a locking post 126 at an end opposite to the plurality of post receivers 124, which may comprise any appropriate locking post known in the art. The locking post 126 may comprise a standardized locking pin 206 receiver in the main body 100 that allows an interchangeable attachment to be locked to the main body 100 when installed. The locking pin 206 may be any appropriate lock such as, for example, a spring-loaded pin or a detent, which may engage to lock each of the plurality interchangeable attachments to the main body 100.

In one embodiment of the electromagnetic resistance smart gym having quick attach pulleys and interchangeable attachments the interchangeable attachment may comprise a workout bench 200, which may comprise a standard workout bench upon which various exercises may be performed. One leg of the workout bench 200 may comprise a plurality of posts 202 and the other leg of the workout bench 200 may comprise a locking bracket 204. A locking pin 206 may attach through the locking bracket 204 to the locking post 126 to lock the workout bench 200 to the main body 100.

To begin using the device a user may first install the workout bench 200 to the main body 100. The user may then connect any adjustable pulleys 134 desired to route the cables 110 to a preferred position. The user may then perform an exercise, pulling the cables 110 simultaneously against the motors 106.

In one embodiment of the electromagnetic resistance smart gym having quick attach pulleys and interchangeable attachments the interchangeable attachment may comprise a vertical climber 300, which may comprise an A-frame or ladder frame design upon which a plurality of hand holds and steps are attached. One leg of the vertical climber 300 may comprise a plurality of posts 202 and the other leg of the vertical climber 300 may comprise a locking bracket 204. A locking pin 206 may attach through the locking bracket 204 to the locking post 126 to lock the vertical climber 300 to the main body 100. The vertical climber 300 may further comprise a plurality of internal pulleys 304 routing an internal cable 302, which is connected to the hand holds and steps.

To begin using the device a user may first install the vertical climber 300 to the main body 100. The user may then connect each side mechanism of the vertical climber 300 to its respective cable 110.

The user may then attach a first cable 110 to a first cable attachment and may attach a second cable 110 to a second cable attachment of the vertical climber 300. The first cable attachment may be connected to a first end of the internal cable 302, and the second cable attachment may be connected to a second end of the internal cable 302. In this way the first cable 110 and the second cable 110 are pulling in opposite directions relative to one another through the internal cable 302. The user may then perform an exercise, pulling the cables 110 alternatingly and continuously against the motors 106.

In one embodiment of the electromagnetic resistance smart gym having quick attach pulleys and interchangeable attachments the interchangeable attachment may comprise a rowing machine 400, which may comprise a sled design upon which a seat, foot pedals, and a hand pull are attached. One leg of the rowing machine 400 may comprise a plurality of posts 202 and the other leg of the rowing machine 400 may comprise a locking bracket 204. A locking pin 206 may attach through the locking bracket 204 to the locking post 126 to lock the rowing machine 400 to the main body 100.

To begin using the device a user may first install the rowing machine 400 to the main body 100. The user may then attach both of the cables 110 to the hand pull of the device and may then perform an exercise, pulling the cables 110 simultaneously against the motors 106.

In one embodiment of the electromagnetic resistance smart gym having quick attach pulleys and interchangeable attachments the interchangeable attachment may comprise a stationary bicycle 500, which may comprise a stationary bicycle design having a scotch yolk mechanism 502 within its pedal assembly. One leg of the stationary bicycle 500 may comprise a plurality of posts 202 and the other leg of the stationary bicycle 500 may comprise a locking bracket 204. A locking pin 206 may attach through the locking bracket 204 to the locking post 126 to lock the stationary bicycle 500 to the main body 100.

To begin using the device a user may first install the stationary bicycle 500 to the main body 100. The user may then attach a first cable 110 to a first cable attachment and may attach a second cable 110 to a second cable attachment of the stationary bicycle 500. The first cable attachment may be connected to a first side of the linear guide 506 of the slider 504, and the second cable attachment may be connected to a second side of the linear guide 506 of the slider 504. In this way the first cable 110 and the second cable 110 are pulling in opposite directions relative to one another. The piston 508 inserts into the slider 504, and the rotation of the piston 508 caused by the pedaling action of the exercise causes the slider 504 to move alternatingly forward and backward in a linear motion. Such a design may be known as a Scotch Yolk mechanism. The user may then perform an exercise, pulling the cables 110 alternatingly and continuously against the motors 106.

The electromagnetic resistance smart gym having quick attach pulleys and interchangeable attachments may be substantially constructed of any suitable material or combination of materials, but typically is constructed of a resilient material or combination of materials such that the device is resistant to damage as a result of compression, twisting, heating, or submersion in water. As an example, and without limiting the scope of the present invention, various exemplary embodiments of the electromagnetic resistance smart gym having quick attach pulleys and interchangeable attachments may be substantially constructed of one or more materials of steel, aluminum, brass, fiberglass, carbon fiber, plastic, acrylic, polycarbonate, polyester, nylon, denim, cotton, silicone, or combinations thereof. In some embodiments the various components of the device may be coated, lined, or otherwise insulated to prevent contamination of the device. In one embodiment the material of construction may vary from one component to the next within the system.

In one embodiment the electromagnetic resistance smart gym having quick attach pulleys and interchangeable attachments may comprise a resilient material of construction that either comprises a material having antimicrobial properties or comprises a layering of antimicrobial material or coating. Antimicrobial properties comprise the characteristic of being antibacterial, biocidal, microbicidal, anti-fungal, antiviral, or other similar characteristics, and the oligodynamic effect, which is possessed by copper, brass, silver, gold, and several other metals and alloys, is one such characteristic. Copper and its alloys, in particular, have exceptional self-sanitizing effects. Silver also has this effect, and is less toxic to users than copper. Some materials, such as silver in its metallic form, may require the presence of moisture to activate the antimicrobial properties.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

I claim:

1. An electromagnetic resistance smart gym, comprising:

a main body;

a plurality of motors;

a plurality of spools;

a plurality of cables;

a plurality of fixed flip-flop pulleys;

a plurality of adjustable pulleys;

a plurality of pulley receivers; and an interchangeable attachment;

wherein said main body comprises a flat base containing said plurality of motors and said plurality of spools within an internal cavity;

wherein each one of said plurality of motors exerts a rotational force upon a respective spool of said plurality of spools;

wherein each one of said plurality of cables is wound around a respective spool of said plurality of spools;

wherein said plurality of cables extend through the main body to a respective outer side of said main body;

wherein said main body further comprises said plurality of pulley receivers;

wherein said main body further comprises a plurality of post receivers and a locking post;

wherein said interchangeable attachment is attachable to said main body; and wherein said plurality of cables are attachable to said interchangeable attachment.

2. The electromagnetic resistance smart gym of claim 1, wherein said interchangeable attachment comprises a workout bench;

wherein said workout bench comprises a plurality of posts and a locking bracket;

wherein said plurality of posts of said workout bench are attachable to said plurality of post receivers of said main body; and wherein said locking bracket of said workout bench is attachable to said locking post of said main body.

3. The electromagnetic resistance smart gym of claim 1, wherein said interchangeable attachment comprises a vertical climber;

wherein said vertical climber comprises a plurality of posts, an internal cable, and a plurality of internal pulleys;

wherein said plurality of posts of said vertical climber are attachable to said plurality of post receivers of said main body; and wherein a motion of said vertical climber pulls alternatingly and continuously on said plurality of cables.

4. The electromagnetic resistance smart gym of claim 1, wherein said interchangeable attachment comprises a rowing machine;

wherein said rowing machine comprises a plurality of posts and a locking bracket;

wherein said plurality of posts of said rowing machine are attachable to said plurality of post receivers of said main body; and wherein said locking bracket of said rowing machine is attachable to said locking post of said main body.

5. The electromagnetic resistance smart gym of claim 1, wherein said interchangeable attachment comprises a stationary bicycle;

wherein said stationary bicycle comprises a plurality of posts and a scotch yolk pedal mechanism;

wherein said plurality of posts of said stationary bicycle are attachable to said plurality of post receivers of said main body; and wherein a motion of said stationary bicycle pulls alternatingly and continuously on said plurality of cables.

6. The electromagnetic resistance smart gym of claim 1, wherein one of said plurality of adjustable pulleys is quick-attached to one of said plurality of pulley receivers.

* * * * *